US010118089B2

(12) United States Patent
Frederickson

(10) Patent No.: US 10,118,089 B2
(45) Date of Patent: Nov. 6, 2018

(54) INTERACTIVE GAME WITH INNOVATIVE CUP

(71) Applicant: Leslee Frederickson, Wayne, NJ (US)

(72) Inventor: Leslee Frederickson, Wayne, NJ (US)

( * ) Notice: Subject to any disclaimer, the term of this patent is extended or adjusted under 35 U.S.C. 154(b) by 0 days.

(21) Appl. No.: 15/357,584

(22) Filed: Nov. 21, 2016

(65) Prior Publication Data

US 2018/0140940 A1 May 24, 2018

(51) Int. Cl.
*A63F 9/00* (2006.01)
*A47G 19/22* (2006.01)

(52) U.S. Cl.
CPC ..... *A63F 9/00* (2013.01); *A47G 19/2205* (2013.01); *A63F 2250/024* (2013.01); *A63F 2250/04* (2013.01)

(58) Field of Classification Search
CPC .. A63F 7/7249; A63F 2250/0414; A63F 9/00; A47G 19/2205
See application file for complete search history.

(56) References Cited

U.S. PATENT DOCUMENTS

| | | | | |
|---|---|---|---|---|
| 3,739,975 | A | 6/1973 | Davidow | |
| 6,059,138 | A | 5/2000 | Labruyere | |
| 6,164,485 | A | 12/2000 | Hilton | |
| 7,328,788 | B2 * | 2/2008 | Mahieu | A45C 11/005 206/223 |
| 7,402,092 | B1 | 7/2008 | Randall et al. | |
| 7,805,959 | B2 | 10/2010 | Webb et al. | |
| 8,177,233 | B2 | 5/2012 | Grayson | |
| 8,651,492 | B1 | 2/2014 | Cappuccio | |
| 2002/0190115 | A1 | 12/2002 | Schuren et al. | |
| 2005/0029747 | A1 | 2/2005 | Grayson | |
| 2005/0103787 | A1 | 5/2005 | Simcovitch | |
| 2016/0045818 | A1 | 2/2016 | Medway | |
| 2016/0198874 | A1 * | 7/2016 | Pisarevsky | A61J 7/04 206/217 |

FOREIGN PATENT DOCUMENTS

| | | | |
|---|---|---|---|
| CN | 201175206 | Y | 1/2009 |
| CN | 201551045 | U | 8/2010 |
| CN | 201759248 | U | 3/2011 |
| CN | 201822466 | U | 5/2011 |
| JP | H06229 | U | 1/1994 |

* cited by examiner

*Primary Examiner* — Michael Dennis

(57) ABSTRACT

An interactive drinking game comprising a cup; said cup comprising a cylindrical body; said cylindrical body comprising an upper portion and a lower portion; said upper portion to receive a liquid or gelatin; said lower portion comprising recesses for receiving a corresponding circular piece; said circular piece configured to attach to a circular recess of the lower portion of the cup; said circular piece containing at least one written instruction for a plurality of players of the interactive drinking game to execute; and wherein said circular piece is configured to conceal the at least one written instruction from the plurality of players.

12 Claims, 20 Drawing Sheets

INTERACTIVE GAME WITH INNOVATIVE CUP

CLAIM OF PRIORITY

This application is a provisional application and as such claims no priority to any patent or patent application.

FIELD OF THE EMBODIMENTS

The field of the embodiment of the present invention relates to a drinking game utilizing an innovative cup system.

BACKGROUND OF THE EMBODIMENTS

Drinking games are a favorite past time among people of all ages. Drinking games are dubbed such name due to participants or players drinking a liquid, usually alcohol wine or beer from a cup. Most of these game involve cups that act as a container for the liquid but where the cup has no other function other than as a cup. A review of the related technologies reveals the following:

U.S. Pat. No. 6,164,485 discloses a container lid including a base having a rim adapted to fit onto a container, a raised section projecting above the rim, the raised section including an inverted recess, a domed cover attached to the raised section above the recess to create a compartment within and of substantially the same depth as the container lid, and releasable sealing means between the cover and the raised section to provide access to the compartment.

U.S. Pat. No. 8,177,233 teaches a game of skill involving a cup. The representative cup includes: an aperture communicating with a cavity; and a barrier extending partially about the periphery of the aperture such that a portion of the cup lacking the barrier forms a lateral entrance to the cavity, the barrier having an upwardly and outwardly sloping first portion and a downwardly and outwardly sloping second portion, the first portion being located between the second portion and the aperture.

U.S. Pat. No. 8,651,492 discloses an apparatus for playing a drinking game includes a base support member and a vertical pole extending upwardly from the base support member. A vertically extending backboard is secured to the pole adjacent the top thereof and a plurality of hoops are removably secured to the backboard. Plastic drinking cups are held in each of the hoops. The apparatus further includes a plurality of ping pong balls capable of being tossed into and maintained in the cups. The entire apparatus can be disassembled so that it is portable. That is, the hoops are removably secured to the backboard which is removably secured to the vertical pole. In addition, the vertical pole is comprised of several pole sections that fit together in a telescoping manner. The base includes a carrying handle and functions as a carrying case for holding and transporting the pole sections and the hoops with the backboard serving as a cover for the case.

U.S. Pat. No. 7,805,959 disclosed a cup holder for a drinking game as a triangular multi-cup beverage tray and freezer pack insert that holds and chills multiple cups in a "billiard ball rack" formation for use in the drinking game "Beer-Pong," "Beirut," or variations thereof. The cup holder for a drinking game includes cup pockets, indentations or channels in a triangular row formation (front to back) of one cup, two cups, three cups, etc., which are formed in the freezer pack The cup holding freezer pack fits into the triangular tray for added stability. Rubber or neoprene feet are disposed symmetrically on an underside of the bottom of the tray to provide traction during use. Preferably, the placement and depth of the cup pockets provide for the correct orientation of the cups for optimal playing of the drinking game with standard 16-ounce party cups.

U.S. Pat. No. 6,059,138 teaches a slotted cup holder having multiple slots that is adapted to accommodate a variety of beverage container shapes. The cup holder comprises a cylindrical body having two elongated lateral slots for a cup handle, a semi-circular top anterior slot, a large horizontal bottom anterior slot disposed at the front base of the cylindrical body, and an integrally formed elongated flat appendage that extends outward from the rear base of the cylindrical body. The elongated flat appendage serves to secure the cup holder to an appropriately configured table by sliding the appendage between a table rail and the table. The present invention is designed to accommodate not only traditional non-handled cups, but also handled cups, as well as short and long stem wine glasses. The economy of design of the present invention makes the slotted cup holder both practical and inexpensive.

U.S. Pat. No. 7,402,092 teaches a drinking cup that has a removable lid with three different types of drink delivery novelties. The first is a rotary drive dispenser. In which fluid is drawn up in a straw. At the top of the straw is a rotary arm, which is free to rotate. As the fluid is brought up through the straw, it is forced out of holes formed in the rotary arm causing the arm spins around the straw. As it rotates, the fluid is dispensed into a sump where a drinking straw is used to remove it. In the second design, fluid rises up through the straw where it exits the straw like a fountain spray. In the third design, a tall tube extends up from the lid. A ball sits in the tube. As the fluid is brought up, the ball is propelled upward inside the tube.

Various systems and methodologies are known in the art. However, their structure and means of operation are substantially different from the present disclosure. The other inventions fail to solve all the problems taught by the present disclosure, that of an innovative cup capable of securing an object under the cup while still functioning as a cup. The prior art do not teach a game that utilizes a cup that has a function other than storing or drinking liquids. The innovative cup design of the present disclosure is one that secures an object while protecting the object from getting wet. At least one embodiment of this invention is presented in the drawings below and will be described in more detail herein.

SUMMARY OF THE EMBODIMENTS

In general, the present invention and its embodiments teach and describe an interactive drinking game comprising a cup; said cup comprising a cylindrical body; said cylindrical body comprising an upper portion and a lower portion; said upper portion to receive a liquid or gelatin; said lower portion comprising recesses for receiving a corresponding circular piece; said circular piece configured to attach to a circular recess of the lower portion of the cup; said circular piece containing at least one written instruction for a plurality of players of the interactive drinking game to execute; and wherein said circular piece is configured to conceal the at least one written instruction from the plurality of players.

In another embodiments the present invention comprises an interactive drinking game; comprising a cup; said cup comprising: an upper portion; a lower portion; a compartment; a conical body; said conical body of cup comprised of the lower portion and an upper portion wherein the upper portion is wider in diameter than the lower portion; said upper portion configured to receive a plurality of liquids. The lower portion comprising a recess and an inner recess for receiving the compartment; and wherein the compartment is configured to slide into the inner recess; and wherein the sliding compartment comprises an elongated outward protrusion; said elongated outward protrusion used by an individual player to slide the compartment to reveal an interior portion; and wherein the inner recess of the compartment is configured to receive at least one written instruction for a plurality of players to interact with the other players; and wherein said compartment is configured to conceal the at least one written instruction from the plurality of players.

The compartment is measured at 1 and ¾ inches. The at least one written instruction is recorded on a slip of paper measured to fit inside the inner recess of the compartment. The cup is comprised of a plurality of materials. The plurality of materials comprise at least one of paper, plastic, resin or composite materials that are dishwasher safe. The plurality of liquids comprise at least one of Jell-O, alcohol beverages, sodas or other drinkable liquids. The plurality of liquids may be hot or cold in temperature. The compartment is sealed and liquid proof. The compartment is comprised of opaque materials to aid in the concealment of the written instructions. The drinking game comprises a booklet with a plurality of perforated slips, wherein each of the perforated slips are comprised of at least one written instruction. The plurality of perforated slips may be blank as well. The at least one written instructions comprise a plurality of tasks including physical tasks, creative tasks and verbal tasks for the plurality of players to execute. The cup is able to receive at least 2 ounces or 60 milliliters of the plurality of liquids. The drinking game may also include at least one uniquely shaped sticker. The drinking game may also comprise a game board. The game board may comprise a receiving port for the cup to be placed into.

An improved container comprising an upper portion; a lower portion; a compartment; a body comprised of the lower portion and an upper portion; said lower portion comprising a recess for receiving the compartment and an inner recess; and wherein the compartment is configured to slide into the inner recess; and wherein the sliding compartment comprises an elongated outward protrusion; said inner recess sis configured to receive the elongated outward protrusion; and wherein the compartment is configured to receive a plurality of objects in an interior portion; and wherein said interior portion of the compartment conceals the plurality of objects. The improved container may comprise a plate or bowl wherein the plurality of objects to be concealed may comprise at least one of papers, food or utensil.

DESCRIPTION OF THE PREFERRED EMBODIMENTS

Figure 1:
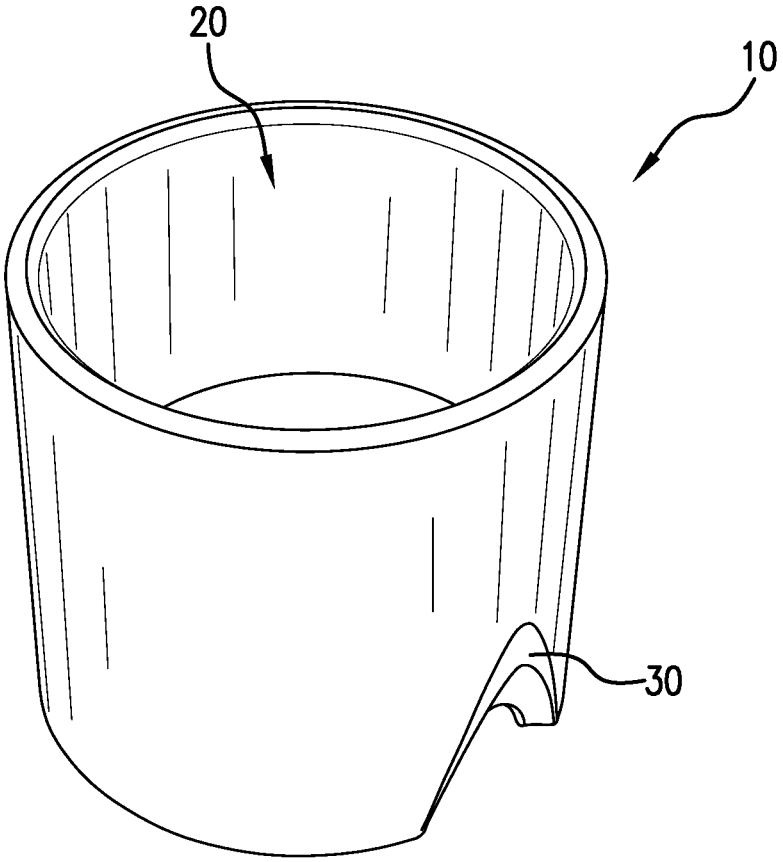
FIG. 1 is a perspective view of the cup of the present invention.
Figure 2:
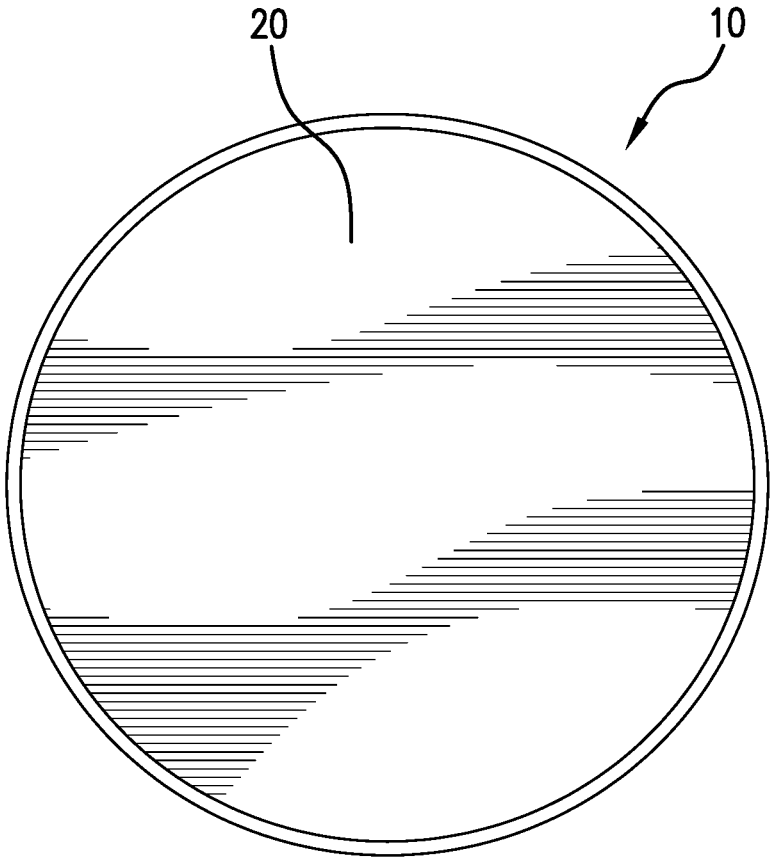
FIG. 2 is a top view of the cup of the present invention.
Figure 3:
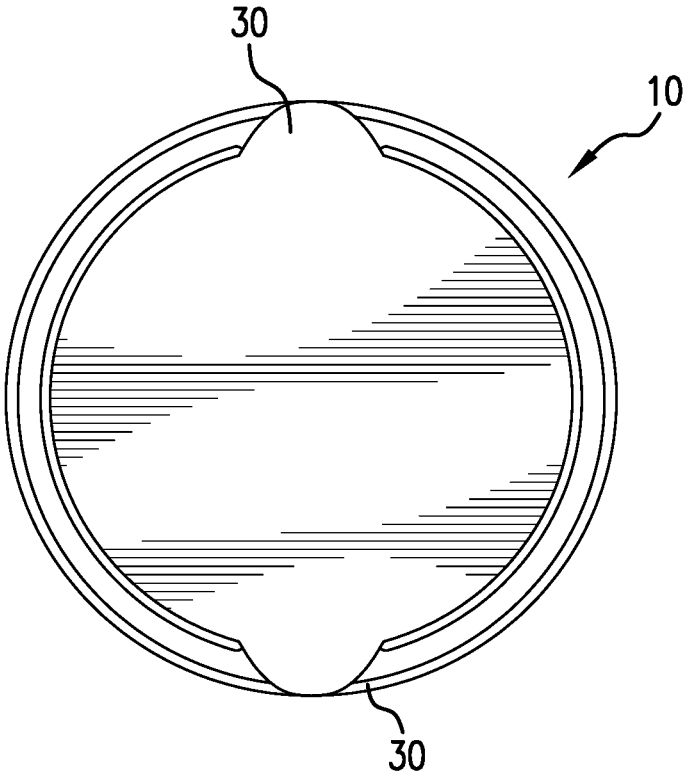
FIG. 3 is a bottom view of the cup of the present invention.
Figure 4:
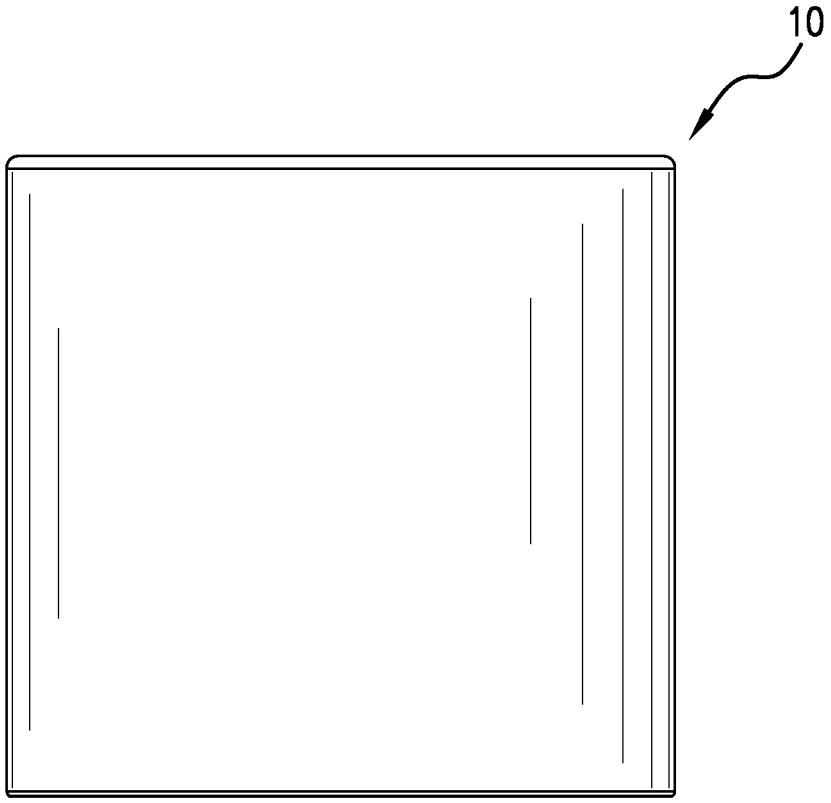
FIG. 4 is a side view of the cup of the present invention.
Figure 5:
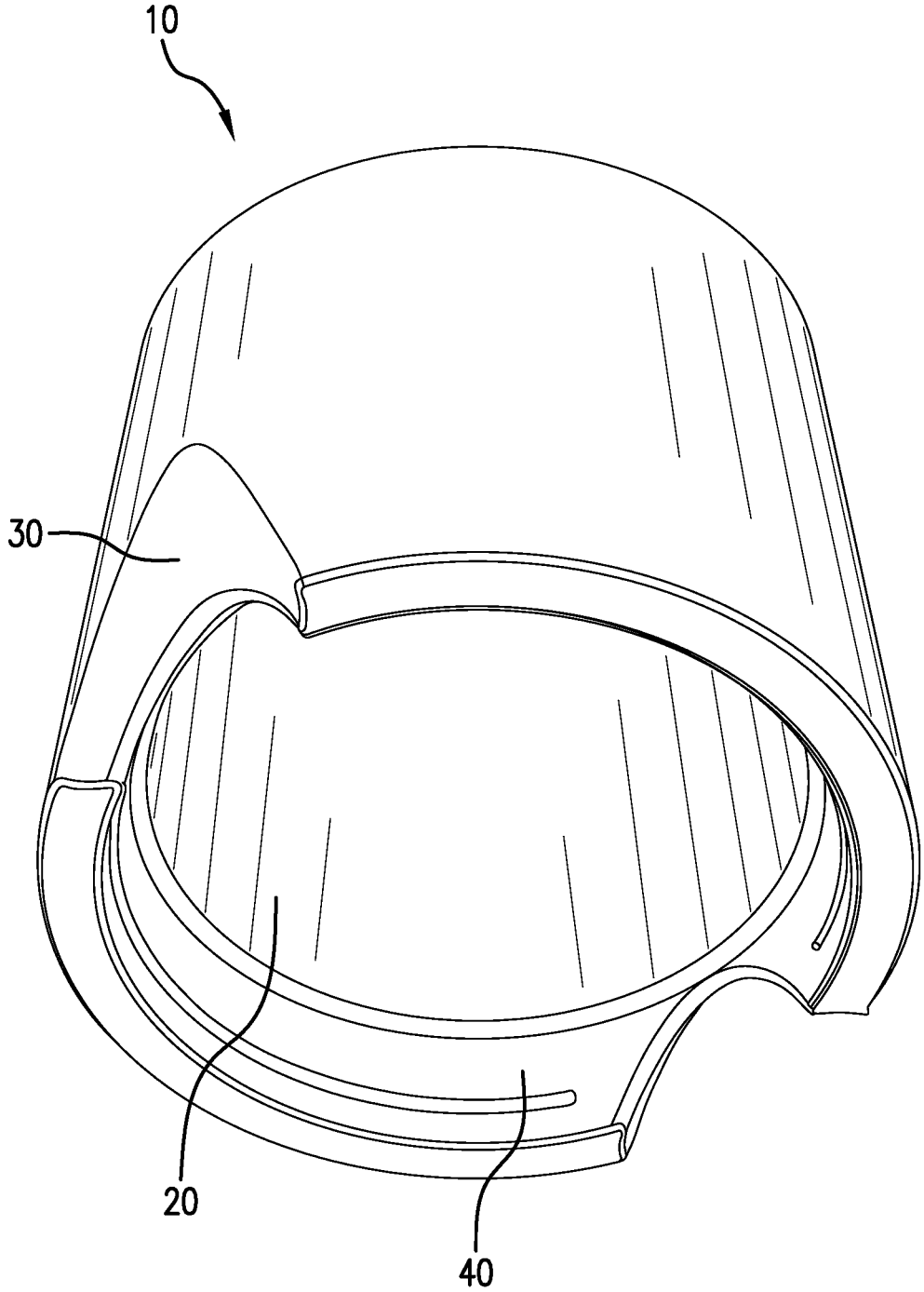
FIG. 5 is a bottom perspective view of the cup of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 6:
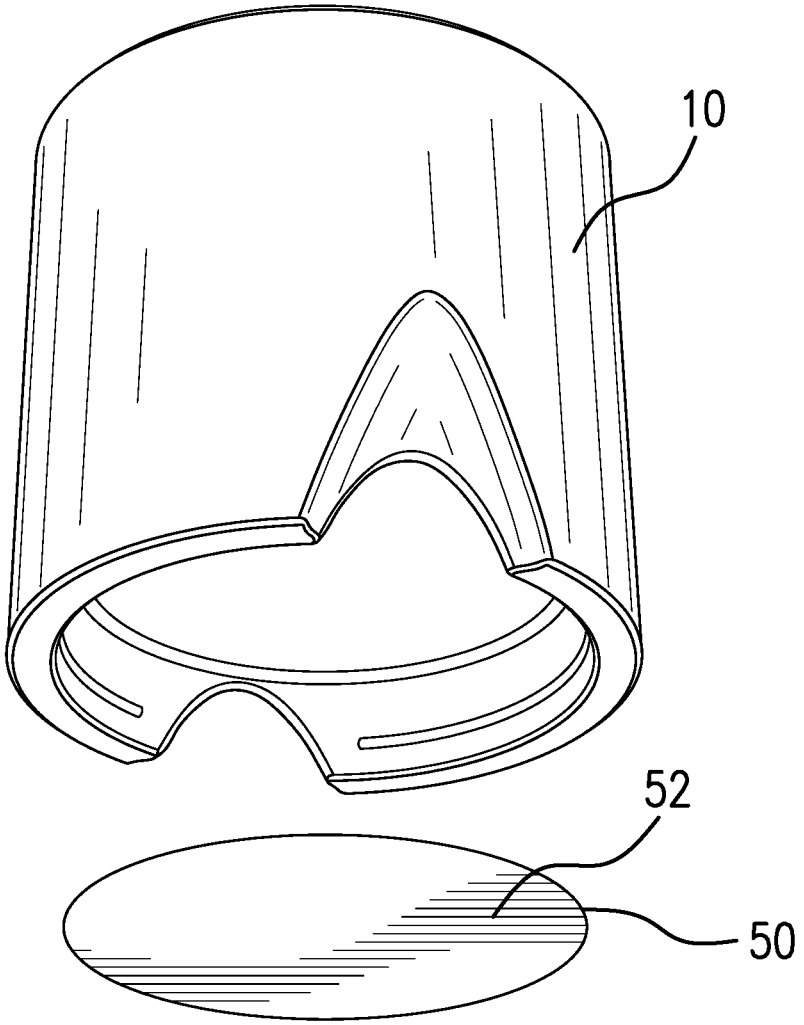
FIG. 6 is a bottom perspective view of the cup of the present invention showing the chip.
Figure 7:
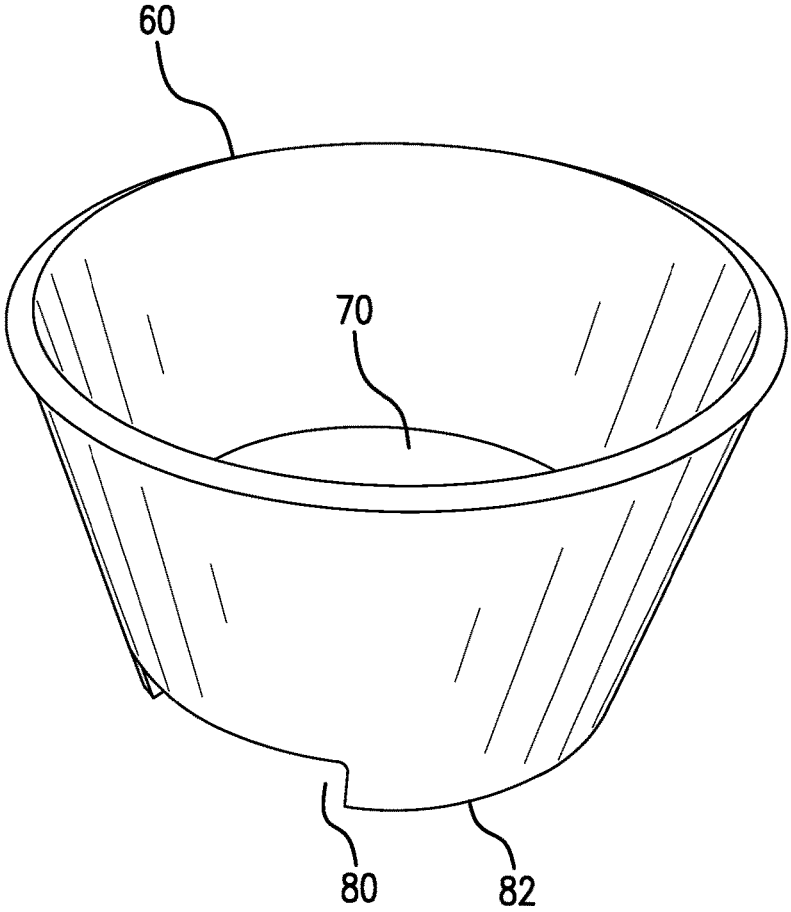
FIG. 7 is an alternative embodiment of the present invention.

Referring now to FIG. 1-5, a perspective view, top view, bottom view, and side view of the cup is shown. FIG. 6 is a bottom perspective view of the cup of the present invention showing the chip.

As shown in FIG. 1-FIG. 6, the invention comprises a cup 10 with a cylindrical body. The cylindrical body has an upper portion and a lower portion. The upper portion can receive a liquid or gelatin in its interior 20. The lower portion comprises recesses 30 for receiving a corresponding circular piece 50 (see FIG. 6). The circular piece 50 is configured to attach to circular recess 40 of the lower portion of the cup 10. The circular piece 50 containing at least one written instruction 52 for a plurality of players of the interactive drinking game to execute; and wherein said circular piece is configured to conceal the at least one written instruction from the plurality of players.

Figure 8:
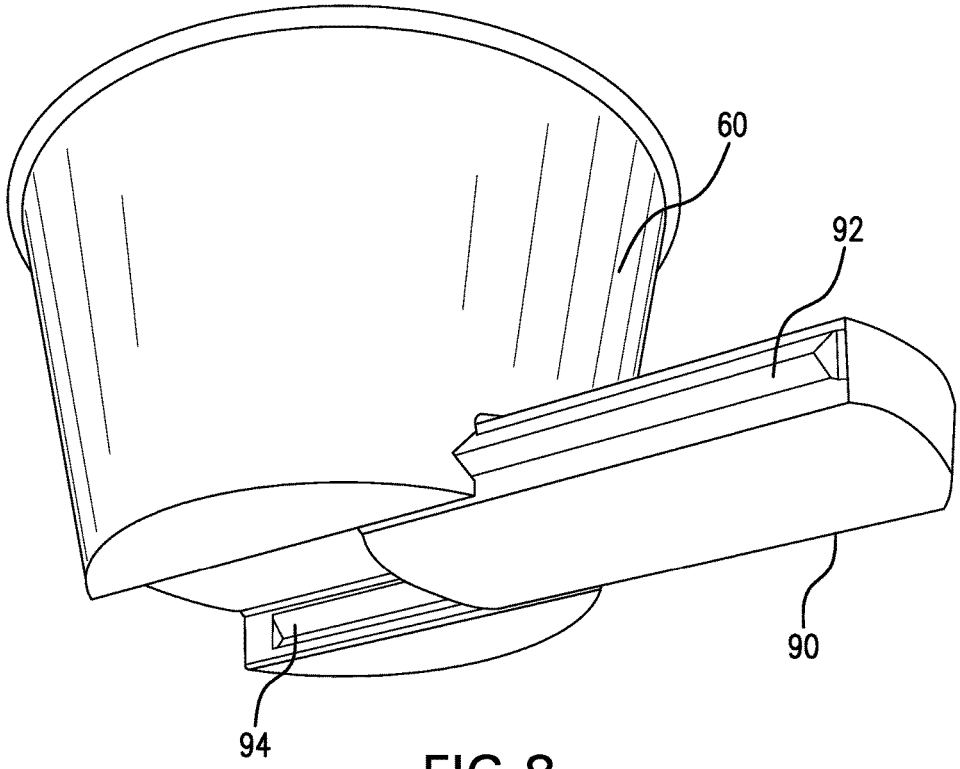
FIG. 8 is bottom perspective of the alternative embodiment of the present invention showing an inserted compartment.
Figure 9:
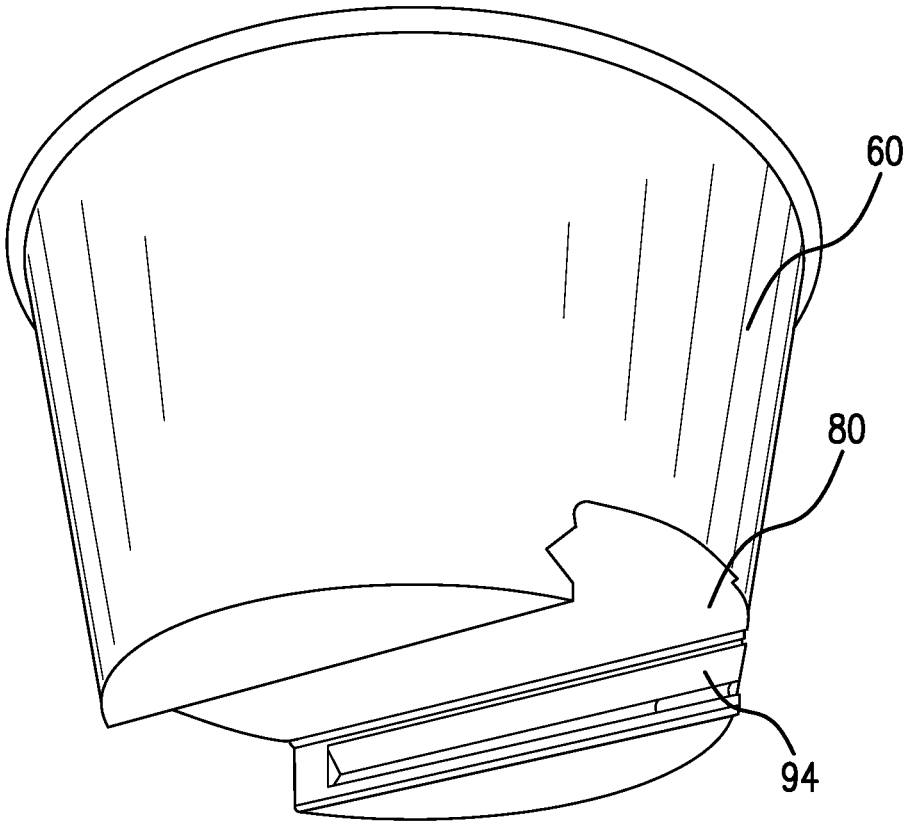
FIG. 9 is a bottom perspective of the alternative embodiment of the present invention without the removable compartment.
Figure 10:
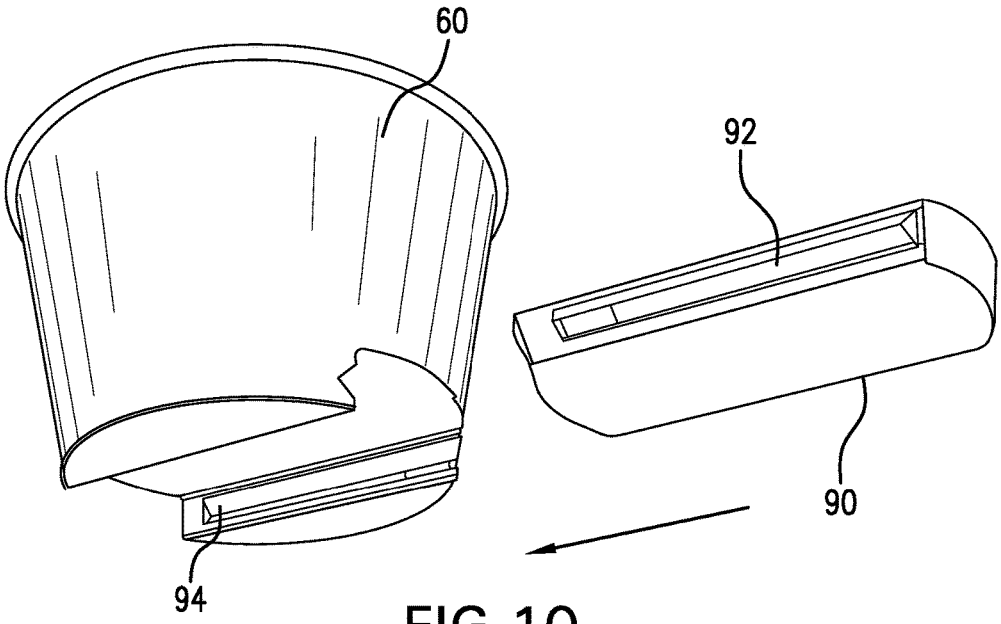
FIG. 10 is another bottom perspective of the alternative embodiment of the present invention showing the compartment being inserted.
Figure 11:
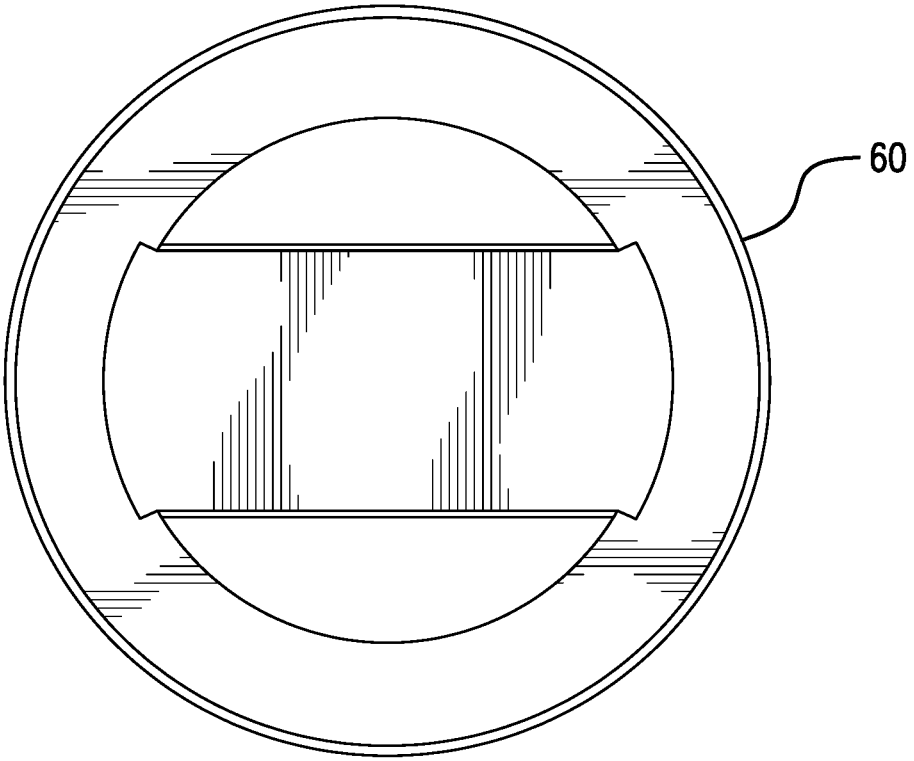
FIG. 11 is a bottom view of the alternative embodiment of the present invention.
Figure 12:
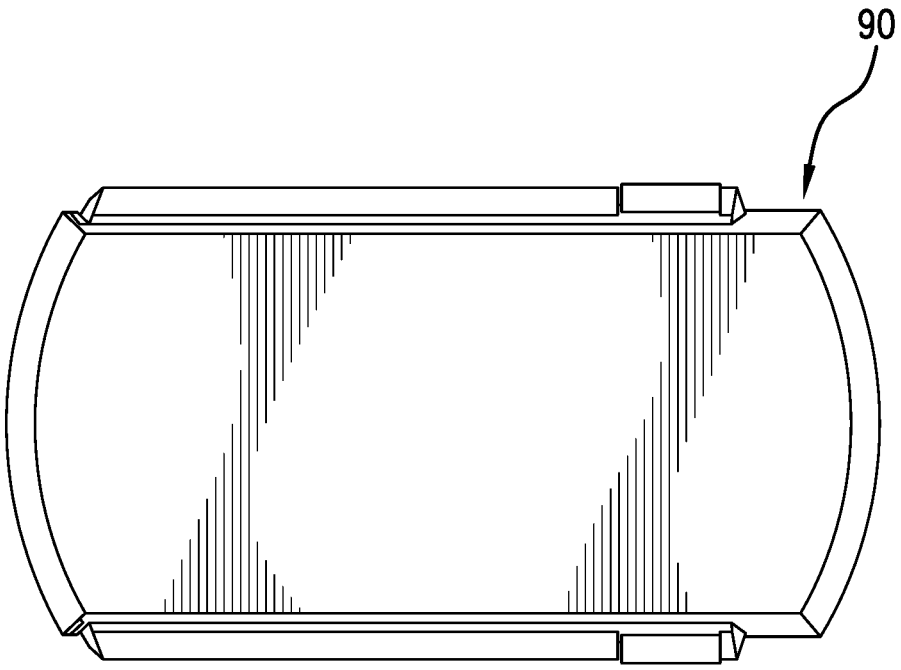
FIG. 12 is a bottom view of the removable compartment of the alternative embodiment of the present invention.
Figure 13:
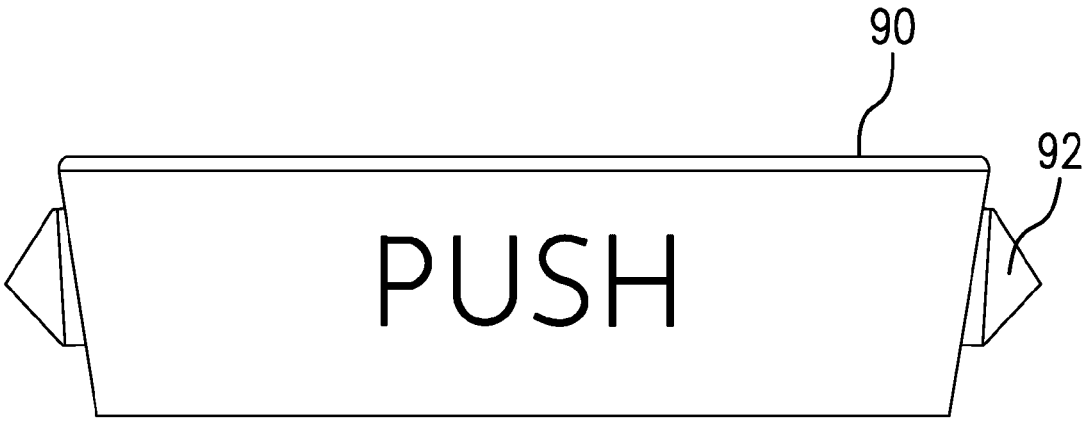
FIG. 13 is a front view of the removable compartment of the alternative embodiment of the present invention.
Figure 14:
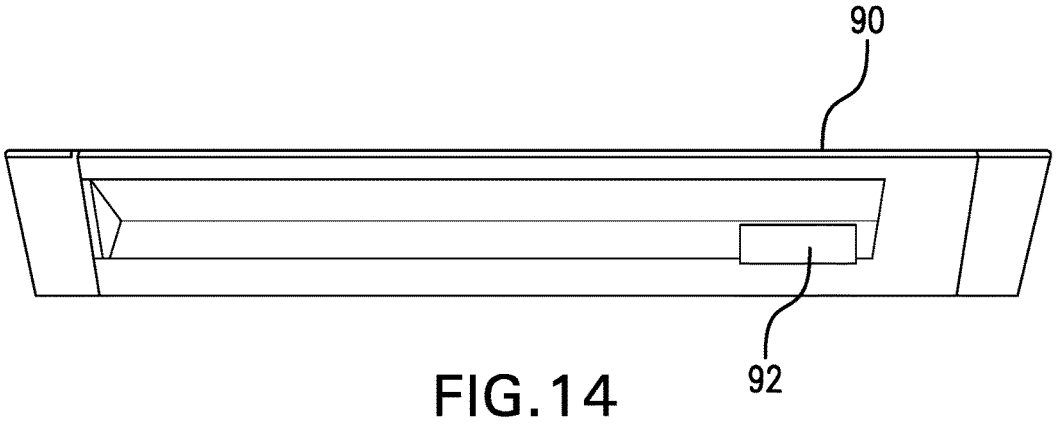
FIG. 14 is a side view of the removable compartment of the alternative embodiment of the present invention.
Figure 15:
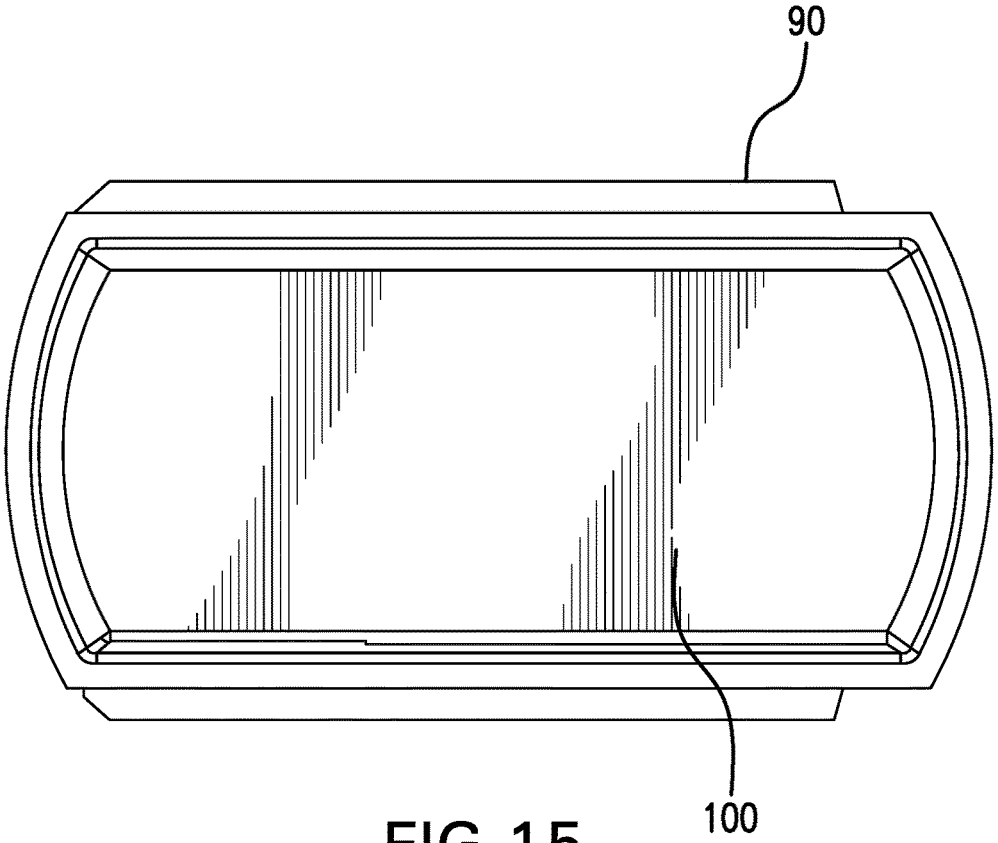
FIG. 15 is a top view of the removable compartment of the alternative embodiment of the present invention bottom view of the cup of the present invention.
Figure 16:
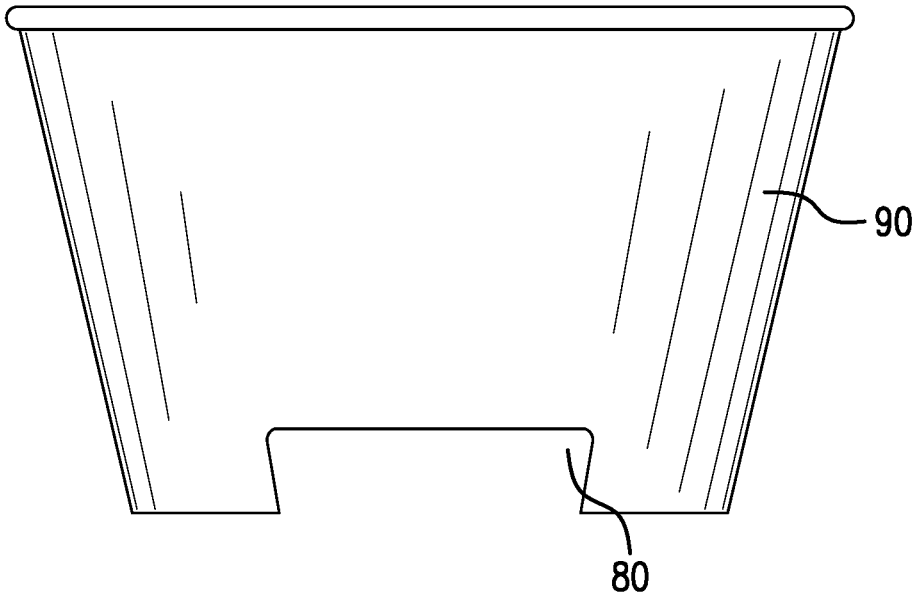
FIG. 16 is a side view of the alternative embodiment of the present invention.
Figure 17:
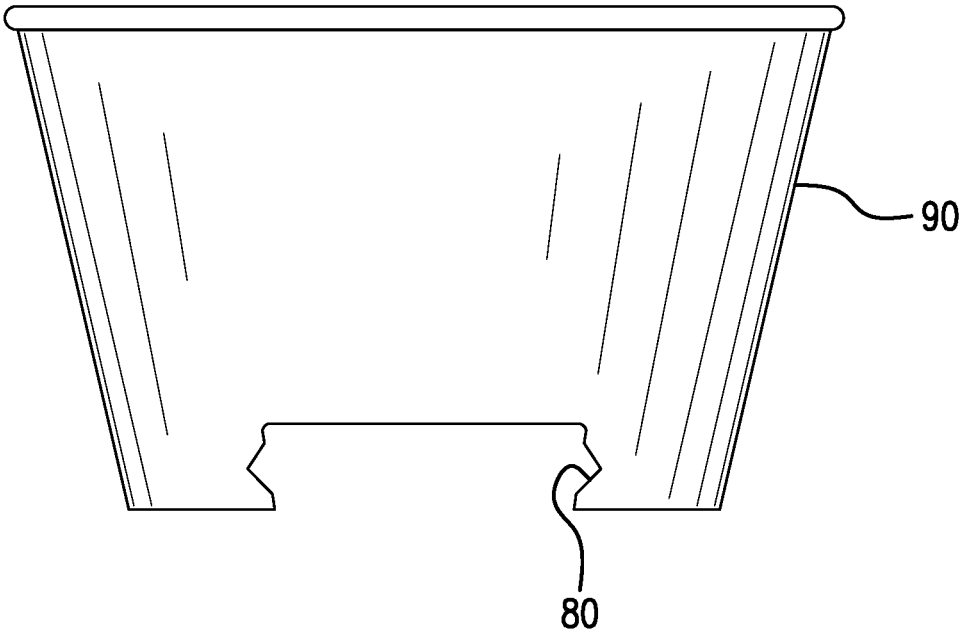
FIG. 17 is a side view of the alternative embodiment of the present invention.
Figure 18:
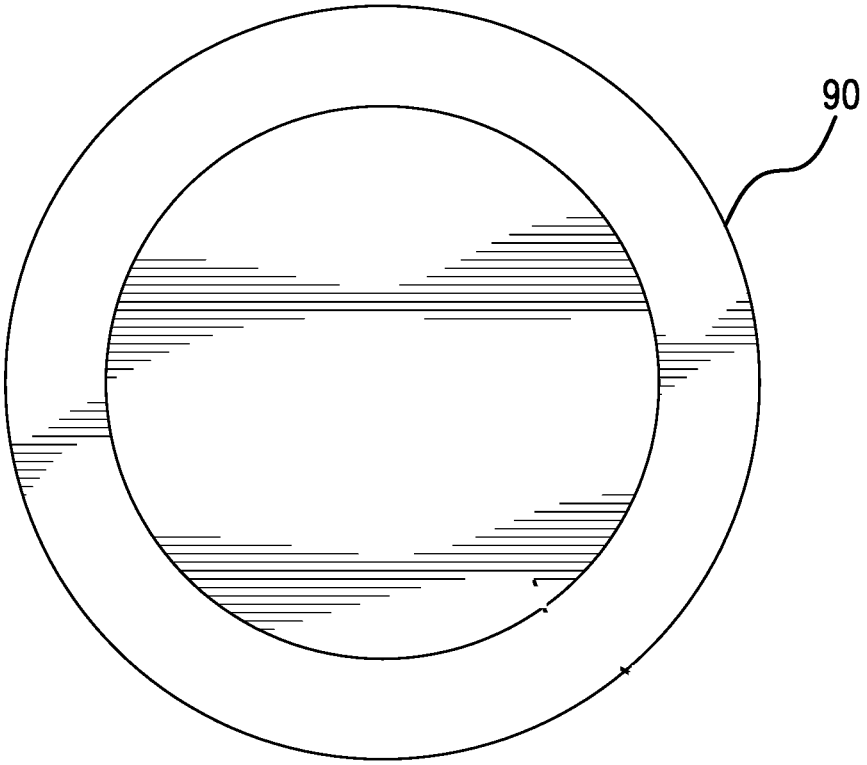
FIG. 18 is a top view of the alternative embodiment of the present invention.

FIGS. 7-11 and FIGS. 16-18 is an alternative embodiment of the present invention. FIG. 12-14 is the bottom, front, side and top view of the removable compartment of the alternative embodiment of the present invention. In another embodiment, as shown in FIG. 7-18, the cup or container 60 comprises an upper portion 70; a lower portion 82; and a compartment 90 (as shown in FIG. 8). The upper portion 70 can hold liquids or gelatin substances. The lower portion 82 of the cup 60 has a recess 80 for receiving the compartment 90 and an inner recess 94 for receiving the compartment 90. As shown in FIG. 8, the compartment 90 is configured to slide into the inner recess 94 of the cup 60. The sliding compartment 90 comprises an elongated outward protrusion 92 which slides into the corresponding inner recess 94. The compartment 90 is configured with an interior portion 100 (as shown in FIG. 15) to receive a plurality of objects. The compartment 90 is configured to conceal a plurality of objects.

Figure 19:
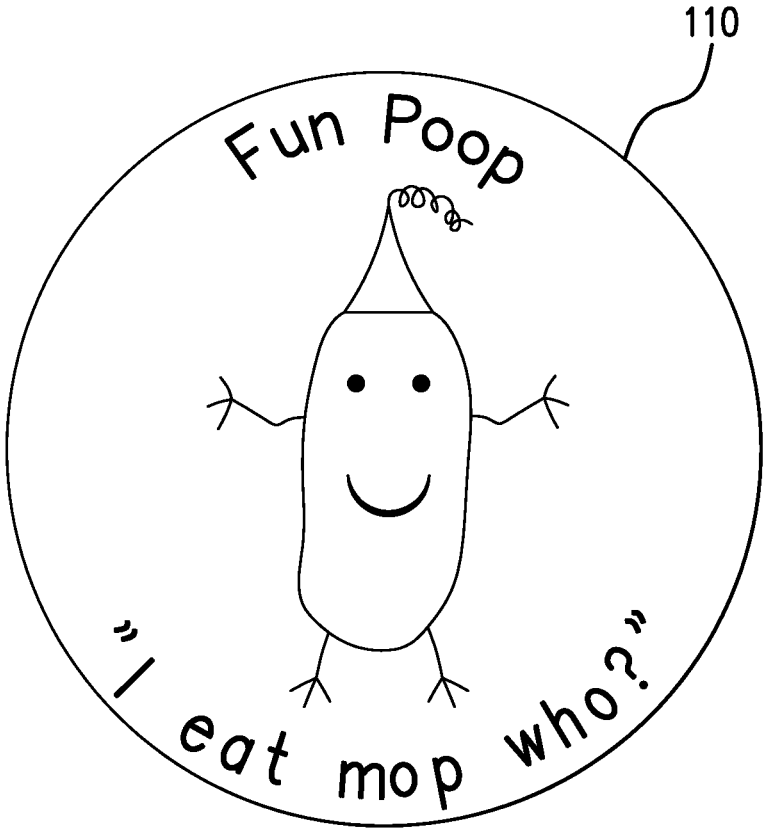
FIG. 19 is a perspective view of the sticker of the present invention.
Figure 20:
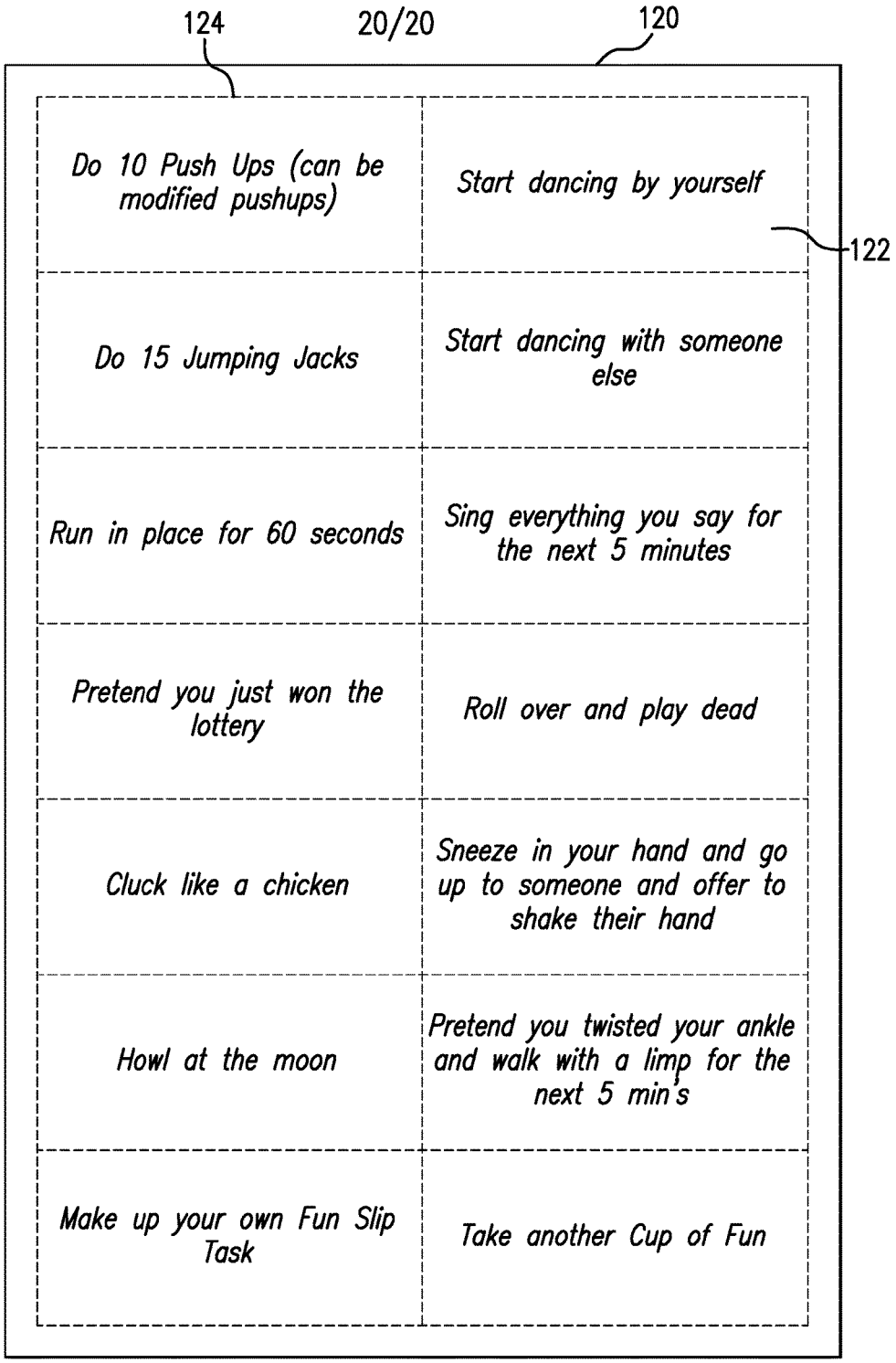
FIG. 20 is a perspective view of one page of the tasks of the present invention.

The drinking game will be known as the Cup of Fun Game. The game will come inside a uniquely shaped box. The box will contain: Cup of Fun Game Directions and 20 Cups with a protective water-proof and concealing holding area/compartment under each cup. As shown in, the cup 10 will hold, secure, conceals and protect the Fun Slips. The cups are distributed evenly among the players. The Fun slips are the set of written instruction or task each player is required to do (as shown in FIG. 20). The box or kit will also contain two-Fun Slip Task Booklets, wherein each booklet will be made of paper and will contain 100 different pre-printed Fun Slip Tasks written on them that must be performed/acted out after the shot is consumed. The box or kit will also contain one Blank Fun Slip Task Booklet. This paper booklet will contain 100 Blank Fun Slips Tasks so that the drinking game party host can create and write-in whatever task they wish on the Fun Slip. The kit or box will also contain a booklet of at least one, preferably 20 stickers branded as Fun Poop Stickers (as shown in FIG. 19) to be used when someone consumes a Cup of Fun drink or shot and fails to perform whatever task is on the Fun Slip within the allotted time. The drinking game party host will determine the amount of time in which the Fun Slip Task must be performed. That person is considered a party pooper if they do not complete the task and thus must wear one of the Fun Poop Stickers for the rest of the game. The sticker will have a picture of a piece of poop that has a smiley face, stick hands and legs, and is wearing a party hat. The sticker may read "I eat mop who?" In other embodiments the sticker can be shaped in other funny, humiliating, or embarrassing objects.

The drinking game rules, procedures and directions begin with the preparation. In preparation the drinking game host, herein the Party Host must prepare the Fun Cup before the party begins. As shown in FIG. 1, the 2 oz Fun Cup 10 is intended to be prepared and filled with a Gelatin (Jell-O) shot the night before the party, but the Party Host can determine whatever type of shot they wish to fill each Fun Cup. Before the party, the Party Host will tear off (along the perforated edges) one individual paper Fun Slip out of the Fun Slip Task Booklet. The party host will then take an empty Fun Cup and under each Fun Cup, there is a secure liquid-proof holding area/compartment that will be able to be accessed and opened. The Party Host will slide open the compartment area and fold and stuff the Fun Slip (similar to a fortune cookie) into that holding area/compartment. In another embodiment, the party host may choose to write the task on the chip that can be secured to another embodiment of the cup. In another embodiment, the kit or box may contain a plurality of circular chips that have printed tasks on them. These circular chips can be chosen by the party host and the appropriate chip secured under the cup. The chips are known as Fun Chips. In another embodiment, the host can log onto a website to print tasks onto precut stickers that can then be stuck on the chip. The Party Host will then slide back the compartment to the bottom of the cup which then seals the compartment and conceals the task from the other players. The compartment is liquid-proof and will secure the fun task since no one should be able to see what is written on the Fun Slip until the game is played, and protect the Fun Slip or Fun Chip. In another embodiment, the chip will be secured to the bottom of the alternative embodiment of the cup, also creating a liquid proof environment and where the task is concealed from the other players. The Party Host will then fill the Fun Cup with 2 oz of the shot of their choice. The second stage of rule, procedures and direction is the actual Game Play. The Party Host can modify or change to rules to suit their party needs. The Party Host will bring out the Fun Cups of their choice (either one of the two embodiment) whenever they chose during the party. Each Fun Cup will have already been prepared, containing one Fun Slip Task (or a Fun Chip) that is hidden in the protective holding area under the cup. The game begins once a Party Go-er consumes a shot from the Fun Cup. After consuming the shot, the Party Go-er will either slide or push out the compartment from the bottom of the Fun Cup and access the Fun Slip Task or remove the chip from the bottom of the cup and access the Fun Chip Task and read whatever is written on the Fun Slip or Fun Chip. The Party Go-er then has a recommended five minutes to prepare and act out and perform whatever task is written on the Fun Slip Task or the Fun Chip. They can chose to perform and act out the task however they chose. Players can be creative, dramatic, or they can be blah blah boring. No matter how the Fun Slip Task or Fun Chip is performed or acted out, it must be done within the allotted time that the Party Host determines. In another embodiment, a timer may be included. In another embodiment of the game, the timer will sound an alarm when there is little time remaining. In another embodiment of the present invention, the kit or box may include rating cards wherein each player has the ability to judge if the Party Go-er has successfully completed the Fun Task. If the Party Go-er does not perform the Fun Slip Task or Fun Chip Task within the allotted time, they must wear the Fun Poop Sticker on the outside of their clothes for the remainder of the party (or until it falls off).

The cups are made of sturdy plastic that is dishwasher safe and able to hold warm to hot fluids (ie: Jell-O shots). There will be 20 Fun Cups in each game will stack together and fit snugly in the Game Box. In another embodiment, there can be less or more than 20 Fun Cups. The compartment and area between the chip and the bottom of the cup will be liquid proof and conceal the paper Fun Slip. Each Fun Cup will have the Cup of Fun Game logo on the outside of the cup. The Fun Cup will conceal the Fun Slip so no one can read what Task is written on each Fun Slip while it's tucked in the holding area/compartment.

The Fun Cup will protect the Fun Slip from getting wet by the contents of the cup. The Fun Cup will hold and secure the Fun Slip in the holding area until the contents are consumed, and then the game begins. The Fun Slip Task Booklets are made of paper. They are disposable and intended for one-time use. One side of the Fun Slip will be the Cup of Fun Game logo and the other side will contain one pre-printed Task that has to be performed written on each individual Fun Slip. In another embodiment, multiple tasks can be written on the Fun Slips for different versions of the game. Each page in the Booklet will contain 10 pre-printed individual Fun Slip Tasks that will have perforated edges (as shown in FIG. 20) so each individual Fun Slip (with one Task written on it) will be able to be folded and torn/ripped out of the Booklet without causing damage to any of the other Fun Slips on the page. These slips of paper can fit inside the compartment or under the chip. Each Booklet will contain 10 pages for a total of 100 Fun Slip Tasks in each Booklet. In another embodiment, there may be more pages and or more slips. Each Cup of Fun Game Box will contain two Fun Slip Task Booklets, for a total of 200 Fun Slip Tasks in each Cup of Fun Game Box. There may be more or less Fun Slips, Booklets, Fun Chips, Fun Cups and other game components in the Cup of Fun Game Box.

Each sticker (as shown in FIG. 19) will have the Fun Poop character. The Fun Poop character will be one single turd, similar to a sausage, and has a smiley face, stick hands and legs, and is wearing a party hat. In another embodiment, the sticker, under each happy Fun Poop character, may contain the words within quotes: "I eat mop who?" So every time someone reads the words, out loud, it will be another party fun experience. In another embodiment, other humorous puns and sayings may be written.

In another embodiment of the present invention, the tasks can match the version of the drinking game such as Dirty Cup of Fun Game, an X-rated and mature version, First Date Cup of Fun Game, Camping Cup of Fun Game, Bar Friendly Cup of Fun Game, Bachelor/Bachelorette Cup of Fun Game, First Date Cup of Fun Game and Old Timers Cup of Fun Game.

There are all different types of pre-printed Fun Slip Tasks. Some tasks are verbal and some are physical in nature and require the person to act out a Task. All the Tasks require the player to use their imagination and creativity in order to act out the Task in hope to make the party, a party! Tasks may include but not limited to: do 10 Push Ups, do 15 Jumping Jacks, start dancing by yourself, Start dancing with someone else, run in place for 60 seconds, sing everything you say for the next 5 minutes, pretend you just won the lottery, roll over and play dead, cluck like a chicken, sneeze in your hand and go up to someone and offer to shake their hand, pretend to howl at the moon, pretend you twisted your ankle and walk with a limp for the next 5 minutes, make up your own Fun Slip Task, take another Cup of Fun, ask the homeowner if you can get a plunger because you just clogged the toilet, ask someone if they can take off their shoe so you can look at it . . . when they hand it to you, smell it, hand it back to them and say "Thank You", spontaneously, start stretching and tell the people around you that you need to warm up before running in the marathon tomorrow morning, spin in a circle 10×'s, tell the people around you that you need some "alone time" and go stand in a corner for 30 seconds, go to the bathroom, get a long strand of toilet paper, put it hanging out of the back of your pants and walk around the party for 30 mins, if outside go hug a tree . . . If inside go tell a plant that you love it, bark like a dog, meow like a kitten, repeat everything somebody says for the next 5 minutes, tell the person to your RIGHT 5 things that make you happy, pretend to sneeze in your hand and then turn to the person to your LEFT and offer to shake their hand, spontaneously start tap dancing, whistle "Happy Birthday,", start to break dance, pretend you are a doctor and that you have to perform a surgery first thing in the morning and then go take another Cup of Fun, pretend that you can't stop scratching your arm, hum (or sing) National Anthem, pretend to have a cramp in your leg, pretend to be constipated, pretend to build a fire, talk like you're a weather-person, act like Jodie Foster in the movie Nell and 'tay in the wind like a tree, pretend you are mowing the lawn, have a fake sneeze attack, pretend that you own a zoo and that you have to leave soon to go feed the goats, try and convince someone that your Grandfather invented the light bulb, ask the party host if they have duct tape (or crazy glue) and don't tell them why, rearrange the food, pretend to be an airline steward and show everyone where the exits are and where the oxygen is, do the pee-pee dance, mimic the YMCA Dance, pretend you lost your phone and you're waiting for an important phone call, pretend that you are swimming, hug yourself, kiss your hand 10 times in a row, ask someone, "do you come here often?", ponder and debate: Just how much could a wood chuck chuck, if a wood chuck could chuck wood anyway?, explain to someone why the chicken really crossed the road, lay on a couch or sit in a chair and pretend to take a power nap, pick one person and every time they look at you, yell WOOHOO!," see an invisible bird fly by, wear Fun Cup on your head for 5 minutes, shout out the alphabet as fast as you can, rub your eyes and pretend to cry that you want your mommy, ask the host for toothpaste, pretend you are pregnant and that your water just broke, pretend the floor is really hot and that it is burning your feet, scream out loud: "TOUCH DOWN!," debate which way the toilet paper should be hung, walk around with your eyes closed for the next 30 seconds, untie your shoe and then find someone who will tie it, ask someone to feed you, talk with British Accent, talk like Arnold Schwarzenegger, talk like Forest Gump, wax on and Wax off, do Karate Kid Pose, pretend you don't understand English, have a conversation with no one, introduce 5 people to your Imaginary friend, ask some if they heard about that "thing" and when they ask, "what thing", make up what that "thing" is, tell someone you're going to do "it" but don't reveal what "it" is, pretend hands are glued to your hips, pretend to see a mouse, when you eat something, exaggerate about how GOOOOOD it tastes, ask for the soda recipe, walk the runway like a super model, raise your glass and toast yourself, toast the bride and groom, pretend to jump rope and then ask someone to join you to do the double Dutch, laugh out loud with an obnoxious laugh, ask if you can order Chinese food, talk in made up voice with made up language, go out front and ring the door bell and act like you just got to the party, shout out loud "This is NOT an emergency! I repeat, it is NOT and emergency!," start to tell a joke and don't finish it, act confused about everything for 5 minutes, pet an invisible dog, debate: If tree fell in woods, and no one was there to see it, would it make a sound?, ask people how much they paid to get into the party, ask why you drive on the parkway and park in the driveway?, name the colors of the rainbow, sit in a chair and pretend to be on a roller coaster ride, debate: Are zebras black with white stripes, or white with black stripes?, ask the host for the check, give heart felt speech about the party host, start shivering and act like you're freezing cold and ask for a hat and gloves, convince someone that they have something stuck in their teeth, do everything in slow motion, act like you're a mime and are trying to get out of a box, be a statue for 2 minutes, pretend to be hunch back of Notre Dame, give someone a dollar and say, "thanks" and walk away, walk around and say, "not it," walk up to someone and ask to take their order, tell 10 people "thank you for coming," pretend you see ghosts, touch a door knob and pretend it is so hot that it burned your hand, Stop, Drop, and Roll, catch invisible fire flies, smell your arm pits, high-five 5 random people, neigh like a horse, pretend you ate something really spicy hot, start singing in Opera, instead of singing a song, talk it out, shout "Beetle Juice" 3 times, ask: If olive oil comes from olives, then where does baby oil come from, sing: "If you're happy and you know it clap your hands," walk around congratulating people, pretend to hear something and try to find where it's coming from, ask for a quarter and you can't stop asking until someone hands you one but you do not take it and just walk away, go up to someone and say "hey, you know what?" and then walk away, pretend to sleep while standing up, make fish lips and hold that pose for 60 seconds, pretend to catch popcorn in your mouth, look out the window and say, "it's a bird, it's a plane, noooooooo, it's SUPERMAN!," convince that you have seen a real live leprechaun, walk like you're 100 years old, play musical chairs, acct like you're having a hot flash, and ask someone for scissors so you can go cut your hair. The above tasks will either be preprinted on the chips or on the Fun Slips to be inserted into the compartment. The booklet will allow for the Fun Slips to be torn out of the Booklet, then will be folded, and stuffed into the compartment that slides open under the bottom of the cup. Each Booklet may contain 14 preprinted Fun Slips and there will be 11 pages of preprinted Tasks for a total of 154 Preprinted Fun Slip Tasks. There will be 2-Preprinted Booklets in each box. Then there will be an additional Blank Fun Slip Booklet containing 154 Blanks Slips. There may be more or less Fun Slips, Booklets, Fun Chips, Fun Cups and other game components in the Cup of Fun Game Box.

The cups may hold up to 60 milliliters (ml) and is preferably measured as 2½" wide at the top (diameter), 1¾" Wide at the bottom, and 1½" in height. The chip is measured as 1.81 inches in diameter. The compartment is measured as 1 and ¾ inches. In another embodiment, the cups, compartments, and Fun Chips may be of varying sizes.

The kit or box may also include in another embodiment, a plastic folding tray that can fold up and fit into the box and it will hold the Fun Cups while traveling so people can prepare the Game at home and then safely bring them to the party being protected by the Cup of Fun Travel Board! In another embodiment, players may download additional Fun Slip Booklets if they need refills (Blank or Printed Booklets). In another embodiment, the cups may be of varying colors and sizes. The cups may be designed by players on line and specially ordered to match themes such as pink Fun Cups for Breast Cancer with a portion of the proceeds going to American Cancer Association or St. Jude's Children Hospital, teal Fun Cups for April and Child Sexual Awareness Month with portion of proceeds going to non-profit organization, green Fun Cups for St. Patty's day, or mixed orange and black Fun Cups for Halloween.

In another embodiment, the penalty for not doing a task or shot, may be a dunce hat or a pin. In another embodiment, players may be able to vote and establish a winner by possibly offering the person who is voted the winner and giving them something. All contents of the drinking game may be made in the USA with recycled plastic and paper. The box may be made with heavy-duty material and will have a magnet latch that will close and secure the box closed. In a further embodiment of the present invention, reusable button instead of sticker may be used. In another embodiment, the cups design and function may be adapted to a plate or bowl or other cooking, baking or food utensil or container. Such containers can be used to hide recipes, or food items such as condiments or spices.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. An interactive drinking game; comprising a cup; said cup comprising: an upper portion; a lower portion; a compartment; a conical body; said conical body of cup comprised of the lower portion and an upper portion wherein the upper portion is wider in diameter than the lower portion; said upper portion configured to receive a plurality of liquids; said lower portion comprising a recess for receiving the compartment; and wherein the compartment is configured to slide into the recess; and wherein the sliding compartment comprises an elongated piece attached to an outward protrusion; said outward protrusion used by an individual player to slide the elongated piece to reveal in inner recess; and wherein the inner recess of the compartment is configured to receive at least one written instruction for a plurality of players to interact with the other players; and wherein said compartment is configured to conceal the at least one written instruction from the plurality of players; the interactive drinking game further comprising a booklet with a plurality of perforated slips, wherein each of the perforated slips are comprised of at least one written instruction; wherein the game board comprises a receiving port for the cup to be placed into.

2. The interactive drinking game of claim 1, wherein the compartment is measured at 1 and ¾ inches.

3. The interactive drinking game of claim 1, wherein the at least one written instruction is recorded on a slip of paper measured to fit inside the inner recess of the compartment.

4. The interactive drinking game of claim 2, wherein the cup is comprised of a plurality of materials.

5. The interactive drinking game of claim 4, wherein the plurality of materials comprise at least one of paper, plastic, resin or composite materials that are dishwasher safe.

6. The interactive drinking game of claim 1, wherein the plurality of liquids comprise at least one of Jell-O, alcohol beverages, sodas or other drinkable liquids.

7. The interactive drinking game of claim 1, wherein the plurality of liquids may be hot or cold in temperature.

8. The interactive drinking game of claim 1, wherein the compartment is sealed and liquid proof.

9. The interactive drinking game of claim 1, wherein the compartment is comprised of opaque materials to aid in the concealment of the written instructions.

10. The interactive drinking game of claim 1, wherein the at least one written instructions comprise a plurality of tasks including physical tasks, creative tasks and verbal tasks for the plurality of players to execute.

11. The interactive drinking game of claim 1, wherein the cup is able to receive at least 2 ounces or 60 milliliters of the plurality of liquids.

12. The interactive drinking game of claim 1, further comprising at least one uniquely shaped sticker.

* * * * *